US005608503A

United States Patent [19]

Fujiwara et al.

[11] Patent Number: 5,608,503

[45] Date of Patent: Mar. 4, 1997

[54] IMAGE FORMING APPARATUS USING AN INTERMEDIATE TRANSFER MEMBER, AN INTERMEDIATE TRANSFER MEMBER AND IMAGE FORMING METHOD

[75] Inventors: Toshimitsu Fujiwara, Kobe; Shuji Iino, Muko; Hidetoshi Miyamoto, Takatsuki, all of Japan

[73] Assignee: Minolta Co., Ltd., Osaka, Japan

[21] Appl. No.: 375,732

[22] Filed: Jan. 20, 1995

[30] Foreign Application Priority Data

Jan. 21, 1994 [JP] Japan ..... 6-005322

[51] Int. Cl.[6] ..... G03G 15/14; G03G 13/14

[52] U.S. Cl. ..... 399/302; 430/126; 399/318; 399/237

[58] Field of Search ..... 355/271–273, 355/277, 279; 430/126, 124

[56] References Cited

U.S. PATENT DOCUMENTS 2,890,174 6/1959 Mayer .
2,899,335 8/1959 Straugham .
4,542,978 9/1985 Tarumi et al. ..... 355/279
4,984,025 1/1991 Landa et al. .
4,999,677 3/1991 Landa et al. .
5,047,808 9/1991 Landa et al. .
5,089,856 2/1992 Landa et al. .
5,158,846 10/1992 Bujese .
5,243,392 9/1993 Berkes et al. ..... 430/126 X
5,530,532 6/1996 Iino et al. ..... 430/126 X

*Primary Examiner*—Matthew S. Smith
*Attorney, Agent, or Firm*—McDermott, Will & Emery

[57] ABSTRACT

An image forming apparatus including an device for developing an electrostatic latent image formed on a latent image carrying member using a liquid developer containing toner particles dispersed in a fluid medium, and an intermediate transfer member having a surface layer onto which is transferred the developer image from the image carrying member, water absorption of the surface layer being in the range between 0.15 and 10.0 percent by weight.

22 Claims, 6 Drawing Sheets

IMAGE FORMING APPARATUS USING AN INTERMEDIATE TRANSFER MEMBER, AN INTERMEDIATE TRANSFER MEMBER AND IMAGE FORMING METHOD

BACKGROUND OF THE INVENTION

1. Field of the Invention

The present invention relates to an image forming apparatus using an intermediate transfer member, and an intermediate transfer member and image forming method to develop an electrostatic latent image formed on the surface of a latent image carrying member using a liquid developer containing toner particles dispersed in a fluid medium.

2. Description of the Related Art

Electrophotographic methods can be broadly divided into dry developing methods and wet developing methods. Among these methods, wet developing methods using liquid developer containing toner particles dispersed in a fluid medium have realized toner particle sizes in the submicron range and provide advantages of high image resolution, excellent halftone qualities and are easily fixed compared to dry developing methods.

In conventional wet developing methods using toner particles in the submicron range, an electrostatic adhesion force is strengthened between toner and the image carrying member such as a photosensitive member or the like due to the higher charge of the toner. Accordingly, not only is a high electric field is necessary for electrostatic transfer of the toner on the surface of an image carrying member to a recording member such as plain paper, overhead projection (OHP) sheets or the like, but transfer efficiency is extremely poor, and image disruptions during transfer readily occur. Thus, the recording member should have excellent transfer efficiency, for example, disadvantages occur relative to plain paper and OHP sheets when thinner than normal transfer sheets or coated sheets are required. Furthermore, when producing full color images, toner images for each color must be overlaid one upon another via three or four transfers, such that the previously mentioned disadvantages become even more pronounced.

A separate disadvantage of methods which directly transfer toner images maintained on an image carrying member to a transfer sheet such as plain paper and the like is that paper debris such as paper fibers and the like readily adhere to the image carrying member during transfer and reduce the function of developing device, cleaners and the like.

Image transfer methods using intermediate transfer members have been proposed in U.S. Pat. Nos. 5,089,856, 5,047,808, 4,999,677, 4,984,025, and 5,158,846 to improve the previously mentioned disadvantages.

In image transfer methods using the aforesaid intermediate transfer members, after a toner image is developed on the surface of an image carrying member, said toner image is temporarily transferred (primary transfer) to an intermediate transfer drum (or an intermediate transfer belt) disposed so as to make contact with said image carrying member and with an electric field effectively formed therebetween. Thereafter, the toner image is transferred (secondary transfer) to a recording sheet or the like via heat and/or pressure, or electrostatic force generated by an electric field, and the consecutive transfer operations are completed.

Thus, the transfer characteristics required to transfer a toner image from an image carrying member can be maintained by the intermediate transfer member by using the previously described intermediate transfer member, such that the freedom of recording member selectivity is greatly increased. As a result, recording members whose transfer characteristics are different each other such as plain paper, OHP sheet and the like can be used, and even full color images via toner image overlays are easily reproducible.

However, in image forming apparatus and the like using the previously described intermediate transfer members, transfer from an image carrying member (primary transfer) in combination with liquid developer technology is inadequate and produces image drift. Thus, transfer efficiency when transferring a toner image from said intermediate transfer member to a recording member (secondary transfer) is also inadequately accomplished.

SUMMARY OF THE INVENTION

An object of the present invention is to provide an image forming apparatus which is provided with an intermediate transfer member and develops via a liquid developing method, and which is capable of suppressing the generation of image drift.

Another object of the present invention is to provide an image forming apparatus having a high transfer efficiency relative to transfer of a developed image from an intermediate transfer member to another recording member.

Another object of the present invention is to provide an intermediate transfer member which suppresses the generation of image drift when developing by a liquid developing method.

A further object of the present invention is to provide an intermediate transfer member having a high transfer efficiency relative to transfer of a developed image from said intermediate transfer member to another recording member.

A still further object of the present invention is to provide an image forming method which suppresses generation of image drift when transferring a developed image from said intermediate transfer member to another recording member after said image developed by a liquid developing method has been transferred to said intermediate transfer member.

An even further object of the present invention is to provide an image forming method having a high transfer efficiency relative to transfer of a developed image from said intermediate transfer member to another recording member.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
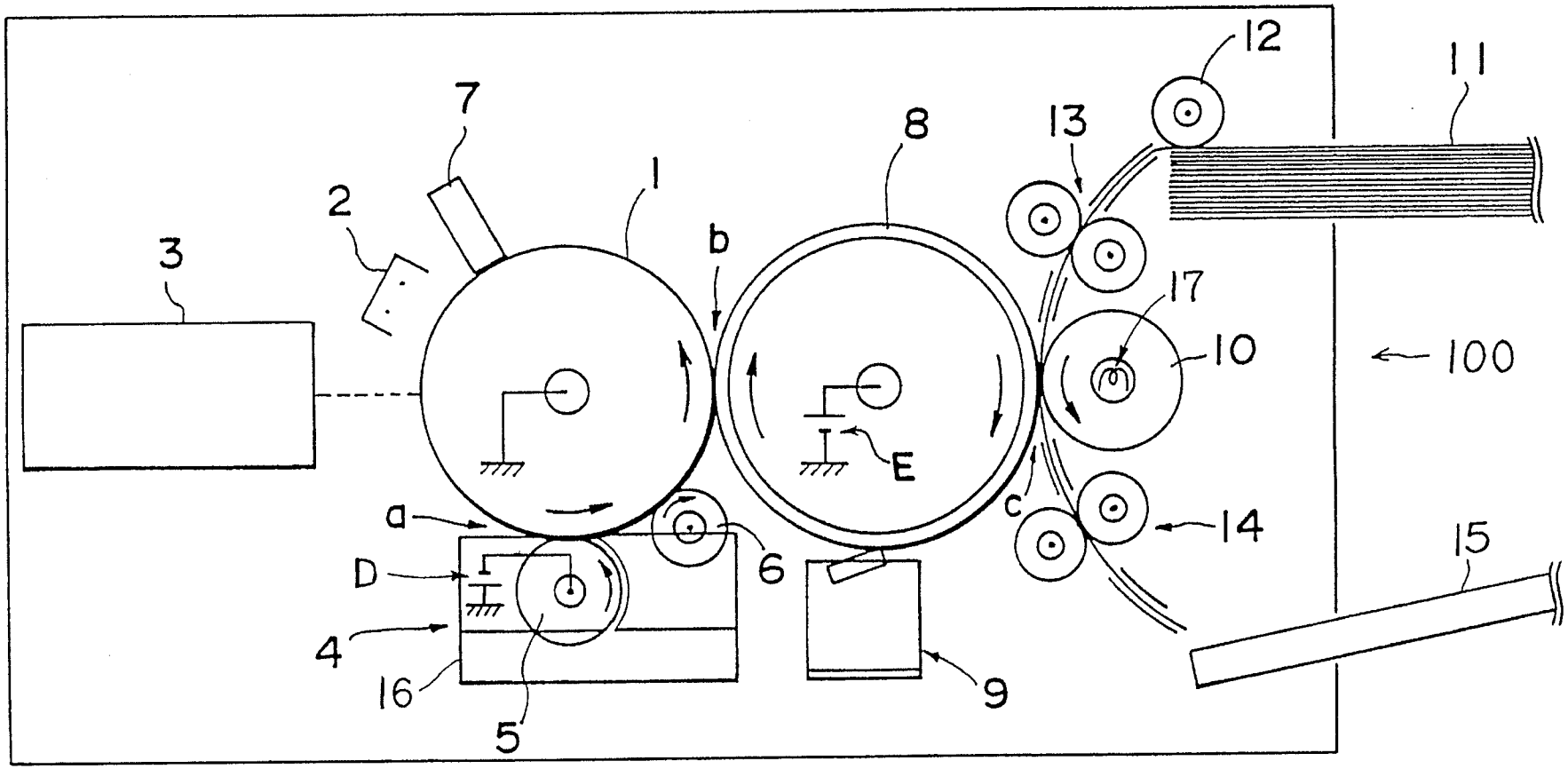
FIG. 1 briefly shows an image forming apparatus adapted to the present invention.

FIG. 1 briefly shows image forming apparatus 100 of the present invention. As shown in FIG. 1, image forming apparatus 100 comprises photosensitive drum 1 as an electrostatic latent image carrying member, scorotron charger 2 for uniformly charging the surface of said photosensitive drum 1, laser beam scanner 3 for forming an electrostatic latent image on the surface of said photosensitive drum 1 via optical exposure of said surface of photosensitive drum 1 in accordance with image information, developing device 4 for developing said electrostatic latent image formed on the surface of photosensitive drum 1 using a liquid developer, discharger 7 for discharging residual charge from the surface of photosensitive drum 1, intermediate transfer member 8 for transferring a toner image formed on the surface of photosensitive drum 1, supplying device 11 for supplying recording sheets, timing roller 13 for controlling the timing for feeding recording sheets from sheet supplying device 11, transfer roller 10 for transferring a toner image formed on the surface of intermediate transfer member 8 onto a recording sheet, cleaning device 9 for cleaning the surface of intermediate transfer member 8, discharge roller 14 for discharging recording sheets, and discharge tray 15 for accommodating stacked recording sheets which have been discharged.

Photosensitive drum 1 comprises an organic photosensitive layer laminated over an aluminum tube having a major diameter of 80 mm. Various kinds of common photosensitive members may be used as the image carrying member of the present invention. Furthermore, the configuration of the aforesaid drum is not limited and may be a belt-like member.

Developing device 4 is provided with developer tank 16 for storing liquid developer, developing roller 5 for accomplishing development, and squeeze roller 6 for removing excess fluid medium from the developer image formed on photosensitive drum 1.

The bottom portion of developing roller 5 is immersed in the liquid developer of developer tank 16, and the liquid developer is maintained on the surface thereof via the rotation of the roller. Developing roller 5 is arranged so as to maintain a minute spacing between itself and photosensitive drum 1, and developing is accomplished by bringing the liquid developer maintained on the surface of the developing roller into contact with photosensitive drum 1. The spacing between developing roller 5 and photosensitive drum 1 may be about 50~300 μm. A predetermined developing bias voltage is applied between developing roller 5 and photosensitive drum 1. The rotational speed of developing roller 5 may be identical to the rotational speed of photosensitive drum 1, or may be faster or slower than the rotational speed of photosensitive drum 1. The directions of rotation of photosensitive drum 1 and developing roller 5 in developing region "a" may be same or opposite directions. Furthermore, the developing device related to the present invention is not limited to the device shown in FIG. 1, and may be optionally modified. For example, a portion of photosensitive drum 1 may be immersed in the developer tank accommodating liquid developer, so as to accomplish development.

Squeeze roller 6 is arranged so as to maintain a minute spacing between itself and photosensitive drum 1, such that fluid medium is removed via pressure contact with the developer image formed on the surface of photosensitive drum 1. The spacing between squeeze roller 6 and photosensitive drum 1 may be about 50~300 μm. A bias voltage may be applied to squeeze roller 6 to prevent adhesion of toner on the squeeze roller.

In image forming apparatus 100 shown in FIG. 1, developing device 4 is disposed so as to confront the bottom of photosensitive drum 1. Furthermore, intermediate transfer member 8 is disposed so as to confront the side of photosensitive drum 1. Transfer roller 10 is disposed at the side of intermediate transfer member 8 on the side opposite photosensitive drum 1. Photosensitive drum 1 and intermediate transfer roller 8 are cylindrical in configuration and have the same diameters.

The image forming apparatus of the present invention is not limited to the apparatus shown in FIG. 1, and may be optionally modified as to size and disposition of various devices.

The operation of image forming apparatus 100 is described hereinafter.

First, the surface of photosensitive drum 1 is uniformly charged to a predetermined electric potential by scorotron charger 2. The charged surface photosensitive drum 1 is then optically exposed by laser beam scanner 3 based on image information so as to form an electrostatic latent image thereon. Liquid developer accommodated in developer tank 16 within developing device 4 is scooped up by developing roller 5 and delivered to developing region "a" in the section of confrontation between developing roller 5 and photosensitive drum 1, so as to develop said electrostatic latent image and form a toner image on the surface of photosensitive drum 1. Power source D applies a predetermined voltage to developing roller 5, and a predetermined developing bias voltage is applied to developing region "a" thereby. Subsequently, squeeze roller 6 squeezes the excess fluid medium in the developer image formed on the surface of photosensitive drum 1, to regulate the state wherein the toner image on the surface of photosensitive drum 1 contains some fluid medium. This toner image is transported to first transfer region "b" formed in the area of confrontation between photosensitive drum i and intermediate transfer member 8 via the rotation of said photosensitive drum 1.

On the other hand, intermediate transfer member 8 begins to rotate, and power source E applies a predetermined voltage to intermediate transfer member 8 (primary transfer bias), such that the toner image on the surface of photosensitive drum 1 is electrostatically transferred to intermediate transfer member 8 (primary transfer). The primary transfer bias at this time is 1,000 V. The nip width of the contact portion between the intermediate transfer member and photosensitive drum is about 2 mm. The primary transfer conditions such as applied voltage and nip width and the like are not limited to the aforesaid and may be optionally modified.

A recording sheet is transported from sheet supplying device 11 to timing roller 13 via the rotation of feed roller 12. Said recording sheet is then delivered to second transfer region "c" formed at the area of confrontation between intermediate transfer member 8 and transfer roller 10 synchronously with the toner image formed on the surface of said intermediate transfer member 8 via the timing roller 13.

The toner image temporarily maintained on the surface of intermediate transfer member 8 is transported to second transfer region "c" via the rotation of intermediate transfer member 8, and is transferred onto the surface of recording sheet by transfer roller 10. Transfer roller 10 is heated to a temperature of 200° C. by an internal heater 17 provided in said transfer roller 10, and makes pressure contact with intermediate transfer member 8 at a linear pressure of 2 kg/cm. The heated temperature of transfer roller 10 is optionally variable within a range of 180°–220° C. Furthermore, the pressure contact force between transfer roller 10 and intermediate transfer member 8 is optionally variable within a range of 1~3 kg/cm.

The toner image is transferred and fixed to the recording sheet by means of the action of the aforesaid heat and pressure exerted by transfer roller 10. The secondary transfer device of the present invention for accomplishing a secondary transfer from intermediate transfer member 8 to the recording sheet is not limited to that shown in FIG. 1, inasmuch as a secondary transfer may also be accomplished by, for example, an electrostatic transfer. In such an instance, a fixing device would be used to fix the toner image to the recording sheet after a secondary transfer thereto.

The intermediate transfer member of the present invention is provided with at least a surface layer, water absorption of the surface layer is 0.15~10.0 percent by weight. Excellent primary transfer and secondary transfer can be achieved by adjusting the water absorption so as to be within the aforesaid range, thereby producing an intermediate transfer member having high transfer efficiency. When the water absorption of the surface layer is less than 0.15 percent by weight, excellent release characteristics cannot be obtained during secondary transfer due to the water content present between the toner particles and the intermediate transfer member. When the water absorption of the surface layer is greater than 10.0 percent by weight, so-called image drift phenomenon readily occurs during development (a phenomenon wherein the image developed on the surface of the photosensitive drum is unsharp and disrupted), due to movement of the excessive water content from the intermediate transfer member to the image carrying member, i.e., photosensitive member or the like, during primary transfer. Increased effectiveness of the present invention is achieved when the water absorption of the materials used to form the surface layer is within a range of 1.5~5.0 percent by weight. Water absorption is defined in Japanese Industrial Standard (JIS) 6911.

The intermediate transfer member may be provided with an electrically conductive support member. Aluminum, iron stainless steel or like metal material may be used as the electrically conductive support member. Resin, paper or the like, at least the surface of which is provided with conduction processing, also may be used. Although the configuration of the aforesaid support member is not particularly restricted, a belt-like or drum-like configuration such as shown in FIG. 1 is preferable.

Particularly when a primary transfer is accomplished by electrostatic transfer, movement of an amount of fluid medium from the photosensitive member surface to the intermediate member is suppressed, providing marked effectiveness in preventing image drift. Furthermore, when a secondary transfer is accomplished by heat and pressure transfer, offset, which becomes a gradual problem in fixing, is prevented and long-term stability of the intermediate transfer member is ensured because a minute amount of water content contained in the intermediate transfer member effectively prevents adhesion of toner particles on the transfer roller and intermediate transfer roller accomplishing heat and pressure transfer.

Adjustment of the water absorption of the surface layer may be accomplished by techniques for forming a surface layer by including additives having high water retention and moisture retention characteristics (i.e., high water absorbing power) among the macromolecular materials having low water absorbing power, or techniques for forming said surface layer with macromolecular materials having a water absorption of 0.15~10.0 percent by weight or having a porous structure. Among the aforesaid techniques, those for forming a surface layer by including additives having high water absorbing power among the macromolecular materials having low water absorbing power are advantageous from the perspectives of low cost and wide range of selectable materials.

Examples of useful materials for forming a surface layer by including additives having high water absorbing power among the macromolecular materials having low water absorbing power include rubbers such as nitrile rubber (acrylonitrile-butadiene-copolymer), chloroprene rubber (polychloroprene), ethylene-propylene rubber (ethylene-propylene terpolymer), silicone rubber (polysiloxane), butyl rubber (isoprene-isobutylene-copolymer), styrene rubber (styrene-butadiene-copolymer), urethane rubber (polyurethane), chlorosulfonated polyethylene rubber, fluororubber (fluorohydrocarbon), epichlorohydrin rubber, acrylic rubber (polyacrylate alkyl ester), and resins such as polycarbonate resins, silicone resins, and polyimide resins. Furthermore, conductive carbon, metals, conductive macromolecules such as polyacetylene, polypyrrole, polythiophene may be added to regulate resistance. The water absorption of said silicone rubber is about 0.01~0.1 percent by weight for example.

Examples of specific useful additives having high water absorbing power include silica which is produced by reacting sodium silicate with an acid in a liquid phase, such as Syloid 150, 244, 266, 63 and the like Syloid series (Fuji-Davison Chemical Co., Ltd.), Finesyl E-50, Finesyl T-32, Finesyl B (Tokuyama Soda Co., Ltd.), K-320 (Degussa Co., Ltd.) and the like, polyglycol ether, ethylene oxide-fatty acid condensate, cationic surface active agents, anionic surface active agents, ampholytic surface active metallic salts, quaternary ammonium salts, stearamide propyldimetyl-β-hydroxyethyl-ammonium nitrate, stearamide propyldimethyl-β-hydroxyethyl-ammonium-dihydrogen-phosphate, specific amine compounds, alkyl-type phosphoric acid ester, Na-alkyl-diphenyl ester-disulfonate, polyoxyethylene-alkylamine, polyvalent alcohol derivatives, alkylamine derivatives, ethylene oxide condensates, organic boron active agents, sodium p-styrenesulfonate and like existing charge inhibitors for macromolecular incorporation, silica gel, synthetic zeolite, allophane, sepiolite and like inorganic moisture absorption agents, polyacrylate, acrylate-vinyl alcohol copolymer, isobutylene-anhydrous maleic acid copolymer, maleic acid ester-vinyl alcohol copolymer, polyethylene oxide crosslinked polymer, carboxymethyl cellulose crosslinked polymer, polymers of starch-polyacrylic acid salts and like water absorbing macromolecules. These additives may be used individually, or in combinations of two or more. The additive amount of said additives differs depending on the kind, but in general the amount of said additives is 1~50 percent by weight of the total weight of the surface layer, and preferably 5~30 percent by weight.

Examples of macromolecular materials usable for forming a surface layer of macromolecules having a water absorption of 0.15~10.0 percent by weight include nylon 6, nylon 6.6, nylon 12 and like polyamide resins, polyacrylate resins, melamine-formalin resin, ethyl cellulose, cellulose acetate and like cellulose resins.

When a surface layer is formed by materials having a porous structure, examples of usable materials include expanded materials of the aforesaid macromolecular materials having low water absorbing power. The intermediate transfer member of the present invention may be constructed so as to provide a cushion layer medially to the conductive support member and the surface layer as required. A cushion layer may use rubber materials and the like added to the aforesaid conductive materials for the purpose of ensuring contact stability, nip width, and pressure regulating relative to the photosensitive member, sheet, and roller.

Furthermore, materials used to construct said cushion layer may be expanded to provide a partially hollow structure for excellent cushioning characteristics. The aforesaid cushion layer may have a multilayer construction to regulate cushioning characteristics and resistance.

Intermediate transfer member having the previously described construction demonstrates particular effectiveness during secondary transfers, i.e., when transferring to a final medium (recording member such as a transfer sheet). Because toner particles have excellent release from the intermediate transfer member, said toner particles readily move from said intermediate transfer member to a final recording member, thereby improving transfer efficiency.

When secondary transfer is achieved by heat and pressure transfer as in image forming apparatus 100 shown in FIG. 1, the intermediate transfer member must have heat resistance. Therefore, it is particularly desirable that silicone rubber, epichlorohydrin rubber or the like be used as the macromolecular materials which forms the surface layer.

Toner particles dispersed in a fluid medium may be used as the liquid developer.

The volumetric mean particle size of toner particles is preferably 0.2~5.0 μm, and ideally 0.5~3.0 μm. When the volumetric mean particle size of the toner particles is greater than 5.0 μm, high precision images cannot be obtained. However, when the volumetric mean particle size of the toner particles is less than 0.2 μm, transfer characteristics decline.

The volumetric mean particle size distribution of toner particles should be sharp, such that 80 percent by volume of the total amount of total particles is preferably (volumetric mean particle size) ±1.0 μm, and ideally (volumetric mean particle size) ±0.5 μm when particle size distribution is broad, development is accomplished by toner particles of a large size, such that developer characteristics change after long-term use.

Specific modes of toner particles include pigment particle units, surface processed pigment particles, pigment particles in absorbed in resin, colored polymer particles colored by dyes or the like.

Fine polymer particles used as the previously mentioned toner particles can be obtained by dry and wet manufacturing methods.

Dry manufacturing methods include dry pulverization methods and spray drying methods and the like. Wet manufacturing methods include in-solvent pulverization methods, suspension polymerization methods, emulsion polymerization methods, nonaqueous dispersion polymerization methods, seed polymerization methods, emulsion-dispersion-granulation methods and the like. Useful polymer particles manufactured by emulsion-dispersion-granulation methods or spray drying methods are desirable due to the many types of usable resins, the ease of molecular weight regulation, resin blending characteristics, and sharpness of particle diameter distributions.

Emulsion dispersion methods dissolve polymers in non-aqueous organic solvent to produce a polymer solution which is emulsion-dispersed in an aqueous solution to form an oil-in-water (O/W) type emulsion. This emulsion is heated while being agitated to vaporize the organic solvents, whereupon the polymer particles are extracted to obtain the polymer micro particles.

Spray drying methods dissolve polymers in organic solvents and regulate the polymer solution in which is dispersed coloring agents and other constituents. The obtained polymer solution is sprayed from nozzles and said spray is heated to vaporize the organic solvents and obtain the polymer micro particles.

When polymer particles of the aforesaid types are used as toner particles in a liquid developer, the polymer particles are washed and dried, and thereafter well known additives are added as required, such as, for example, charge regulating agents, dispersion enhancing agents, resins and the like. These polymer particles may then be dispersed in a fluid medium using a ultrasonic dispersion device or the like.

Examples of coloring agents useful with toner particles include various pigments such as carbon black, phthalocyanine and the like, but are not limited to the aforesaid inasmuch as dyes or resins having color may be used.

Resins useful for toner particles are not specifically limited, and may include, for example, polyether resin, styrene-acrylic copolymer, polystyrene, polyvinyl chloride, polyvinyl acetate, polymethacrylate ester, polyacrylate ester, epoxy resin, polyethylene, polyurethane, polyamide, paraffin wax, and the like used individually or in blends.

Additionally, charge-regulating agents, offset inhibitors and like-constituents may be added as required.

In general, electrically insulative organic substances may be used as the fluid medium. Examples of useful substances include hydrocarbon resins, alicyclic hydrocarbons, aromatic hydrocarbons, halogenated hydrocarbons, polysiloxane and the like. However, isoparaffin solvents are desirable in view of their low cost, odorlessness, and nontoxicity. Specifically, Isopar-G, Isopar-H, Isopar-L, Isopar-K (Esso Co.), Shelzol-71 (Shell Oil Co.), IP Solvent 1620, IP Solvent 2028 (Idemitsu Sekiyu Kagaku K. K.) are particularly desirable. Furthermore, solvents having low electric resistance such as water, water containing gam arabic or polyacrylamide, and the like may be used.

From the perspectives of developing speed, image fogging and the like, the density of toner particles in the fluid medium is preferably 0.5~50 percent by weight, and ideally 2~10 percent by weight. The aforesaid densities are the densities during development, and densities during storage, resupply, transport and the like may be higher densities. Substances used as the fluid medium should be in a fluid state during development, but need not be in a fluid state at room temperature. Accordingly, substances which are solids at room temperature such as various types of waxes, paraffins and the like may be used as the fluid medium of the present invention.

Macromolecules which are soluble in fluid medium, various types of surface active agents may be added as dispersion enhancing agents or dispersion stabilizers to stabilize the dispersion of particles within the liquid developer. Examples of useful substances include polyolefin petroleum resins, linseed oil, polyalkyl(meth)acrylate and the like. Copolymers copolymerized by a small amount of monomers having a polar group such as methacrylate, acrylate, alkylaminoethyl methacrylate and the like may be used to increase the affinity of the polymer particles and fluid medium.

The aforesaid dispersion enhancing agents or dispersion stabilizers may also act as charge-regulating agents to impart an electrical charge to toner particles via their constituents (polar groups or the like).

The amount of additives is not particularly restricted since said amounts will depend on the type, molecular weight, polar groups and the like but should be an amount that does not produce flocculation of particles nor impair dispersion. When the amount of additive is too small, dispersion efficiency is reduced and particle flocculation occurs, whereas when the amount of additive is too great, viscosity of the fluid medium becomes excessive making it difficult for toner particles to move within said fluid medium, thereby markedly reducing developing speed. Accordingly, the amount of additive relative to the fluid medium is preferably 0.01~20 percent by weight, and ideally 0.1~10 percent by weight. If a mixing operation is performed during use of the liquid developer to return it to its original dispersion state no problems will occur in practice relating to the settling of toner particles during long-term storage.

Charge-regulating agents may be added to the fluid medium to impart a charge of whatever polarity to the toner particles. A variety of common materials may be used as charge regulating agents. For example, to impart a positive polarity charge to the developer, metal salts of fatty acids such as stearic acid and the like, and metal salts of organic acids such as metal salts of sulfosuccinic acid ester, metal salts of abietic acid and the like, and solvent polymers such as alkyd resins to attract particles may be used. For example, to impart a negative polarity charge to the developer, surface-active agents such as lecithin and the like, nitrogen compounds, and solvent polymers such as polyamide resins for attracting particles may be used.

The aforesaid charge regulating agents may be added at a rate of 0.0001~10 percent by weight, and preferably 0.001~3 percent by weight of the fluid medium.

Metal oxides such as $SiO_2$, $Al_2O_3$, $TiO_2$, ZnO and the like may be added as charge enhancing agents in the same amounts as charge regulating agents.

Although FIG. 1 shows an example of an image forming apparatus for forming monocolor images provided with a single developing device, it is to be understood that the present invention is not limited to such an arrangement inasmuch as it is also applicable to full color image forming apparatus provided with a plurality of developing devices. For example, the present invention is applicable to image forming apparatus provided with three developing devices respectively accommodating liquid developers incorporating cyan toner, magenta toner, and yellow toner. The present invention is further applicable to image forming apparatus provided with four developing devices which include in addition to the aforesaid three developing devices a fourth developing device accommodating a liquid developer incorporating black toner.

Figure 2:
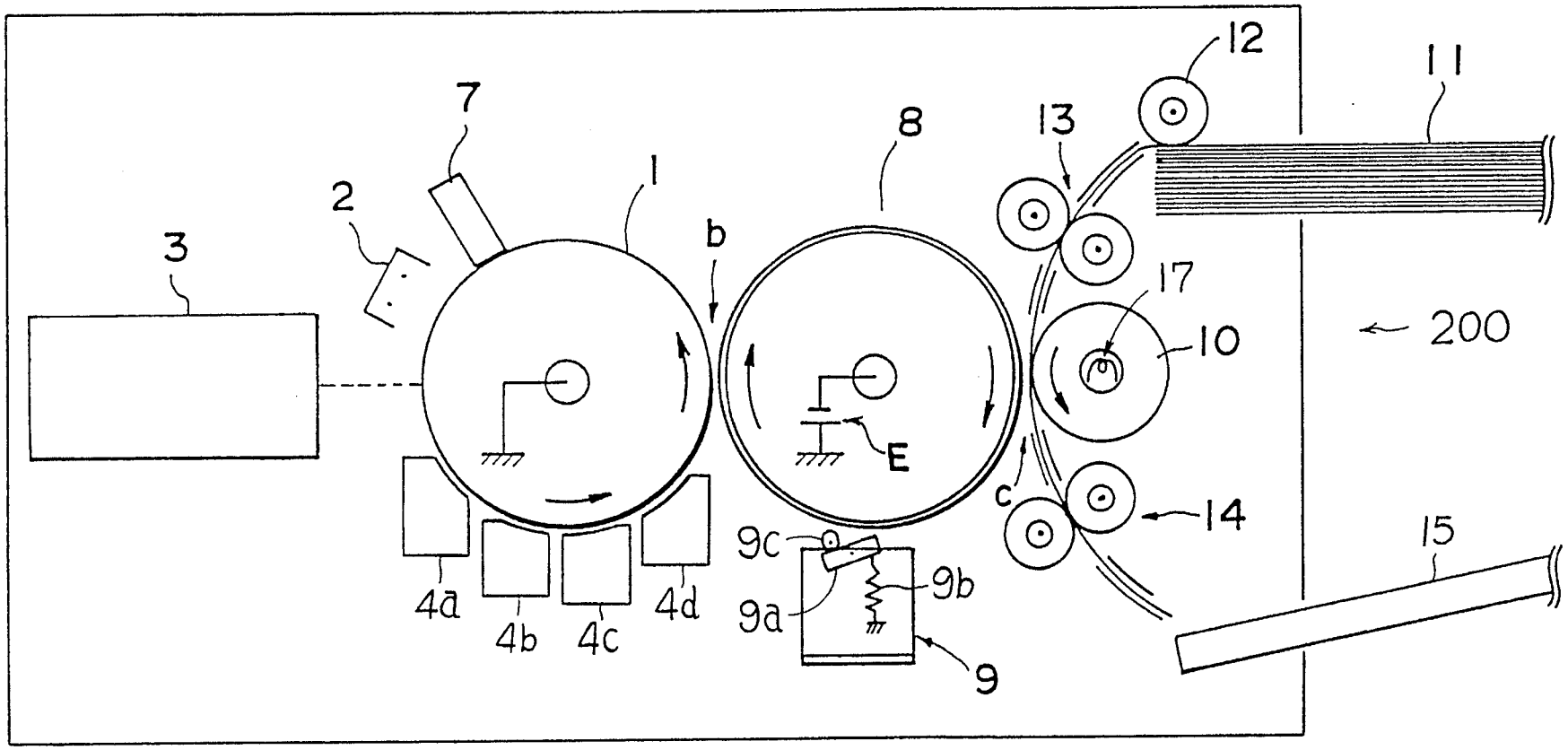
FIG. 2 briefly shows a multicolor image forming apparatus adapted to the present invention.

FIG. 2 shows an example of an image forming apparatus for forming full color images. As shown in FIG. 2, image forming apparatus 200 is provided with four developing devices 4*a*, 4*b*, 4*c*, 4*d* which respectively accommodate liquid developers incorporating cyan toner, magenta toner, yellow toner, and black toner. Each developing device has the same basic construction to that of developing device 4 shown in FIG. 1, wherein a developing roller and squeeze roller are switchable between developing positions in contact with the surface of photosensitive drum 1, and non-developing positions separated from photosensitive drum 1 wherein the action of each roller is not produced on said photosensitive drum 1.

Figure 3:
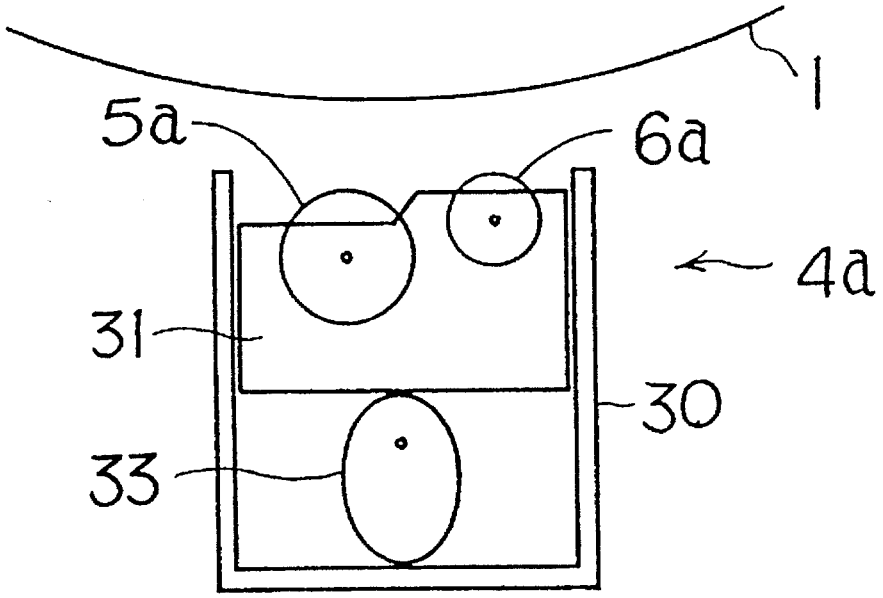
FIG. 3 is a perspective view showing the mechanism by which a developing roller and squeeze roller make pressure contact with and are released from said contact with a photosensitive drum.

FIG. 3 shows the construction for switching the developing roller 5*a* and squeeze roller 6*a* of developing device 4*a* from the non-developing position to the developing position, or from the developing position to the non-developing position. As shown in FIG. 3, developing roller 5*a* and squeeze roller 6*a* are supported by the wall of developer tank 31. Developer tank 31 is supported by support member 30 so as to move vertically. Cam 33 contacts the bottom of developer tank 31. The positions of developer tank 31 is changed via the rotation of said cam 33, namely, raised by cam 33 and lowered by the dead load of developer tank 31. Thus the positions of developing roller 5*a* and squeeze roller 6*a*. Construction of the other three developing devices is identical to the aforesaid.

In cleaner 9 of image forming apparatus 200, cleaning blade 9*a* is operated by spring 9*b* and cam 9*c* to be retractably positioned in contact with intermediate transfer member 8. Normally, said cleaning blade 9*a* is in a state of separation, i.e, non-contact, relative to intermediate transfer member 8.

Transfer roller 10 can also be brought into contact with and retracted from intermediate transfer member 8.

Figure 4:
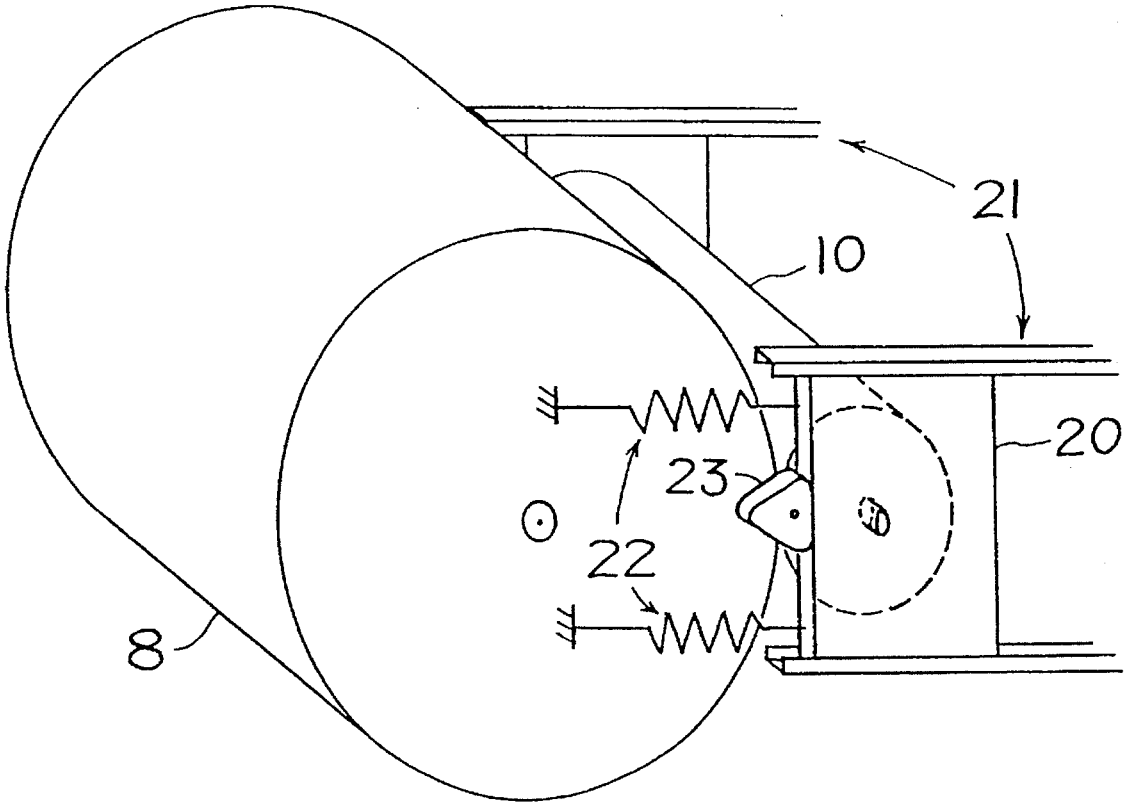
FIG. 4 is a perspective view showing the mechanism by which a transfer roller makes pressure contact with and is released from said contact with an intermediate transfer member.

FIG. 4 is a perspective view showing the mechanism for achieving pressure contact and separation of transfer roller 10 relative to intermediate transfer member 8. As shown in FIG. 4, a pair of support panels 20 provide bilateral support of the transfer roller, and are themselves supported so as to be movable in a horizontal direction along respective slide channels 21. Support panels 20 bring transfer roller 10 into pressure contact with intermediate transfer member 8 via forces exerted by springs 22. Cam 23 makes contact with the side surface of support panel 20 on the transfer roller side. Pressure contact and separation of transfer roller 10 and intermediate transfer member 8 is accomplished via the rotation of cam 23. Normally, the separation state is set.

Image formation by image forming apparatus 200 is described hereinafter.

A beam irradiates the surface of photosensitive drum 1 previously uniformly charged by scorotron charger 2 in accordance with yellow image information transmitted from scanner 3. Then, developing device 4*a*, which among the four developing devices is provided with liquid developer containing yellow toner, is set to the developing state, and development is accomplished. The yellow toner image formed on the surface of photosensitive drum 1 is transferred onto intermediate transfer member 8.

Then, the surface of photosensitive drum 1 is again uniformly charged, and irradiated by a beam in accordance with magenta image information. Developing device 4*b* provided with liquid developer containing magenta toner is set to the developing state, and development is accomplished. The magenta toner image formed on the surface of photosensitive drum 1 is transferred so as to be overlaid on the yellow toner image on intermediate transfer member 8.

Thereafter, identical processes are executed for the cyan image and black image, which are sequentially overlaid on intermediate transfer member 8. When the aforesaid overlays are complete, transfer roller 10 makes pressure contact with intermediate transfer roller 8, and the overlaid toner images formed on the surface of intermediate transfer member 8 are transferred simultaneously as a group onto a recording sheet. When transfer of the toner images onto the recording sheet is completed, cleaning blade 9*a* makes pressure contact with the surface of intermediate transfer member 8, and removes the residual developer from said surface of intermediate transfer member 8.

The present invention relates to image forming apparatus provided with an intermediate transfer member, and is particularly useful as an image forming apparatus for reproducing full color images via overlays of various colors using an intermediate transfer member.

Embodiments of the present invention are described hereinafter by specific examples. In the following examples, "parts" refers to "parts by weight" unless otherwise specified.

Production Of Liquid Developer

One hundred parts low molecular weight polyester resin (MW: 15,000, Mn: 6,000) was dissolved completely in toluene to obtain a density of 1.5 percent by weight. Six parts phthalocyanine were dispersed in the aforesaid resin solution as a coloring agent using an Eiger motor mill (Eiger Japan).

The aforesaid resin solution was spray granulated under conditions of 1 L liquid supplied each hour, 80° C. drying temperature, 5.5 kgf/cm$^2$ spray pressure using Dispacote (Nissei Engineering Co.) to obtain micro polymer particles for use as toner having a mean volume particle size of 2.5 μm was obtained.

Three parts of the aforesaid micro polymer particles for use as toner were added to 100 parts electrically insulated isoparaffin solvent IP Solvent 1620 (Idemitsu Sekiyu Kagaku K. K.), and to this solution were. added 1.5 parts lauryl methacrylate-methacrylate copolymer (lauryl methacrylate/methacrylate=98/2) and 1.5 parts lauryl methacrylate-vinyl pyrrolidone copolymer (lauryl methacrylate/vinyl pyrrolidone=95/5), and dispersed for 20 min using an ultrasonic dispersion device to obtain a liquid developer.

Production of Intermediate Transfer Member 1

Thirty parts of Syloid 150 (Fuji-Davison Chemical Co., Ltd.), a wet process silica, used as a water absorption agent was added to 100 parts TCM5417U (Toshiba Silicone K. K.), used as a conductive silicone rubber.

The aforesaid rubber was compression molded on the surface of an aluminum tube 80 mm in major diameter so as to obtain intermediate transfer member 1 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption of the obtained surface layer at this time was 1.8% as measured by applying correspondingly the method defined in Japanese Industrial Standard (JIS) 6911.

Figure 5:
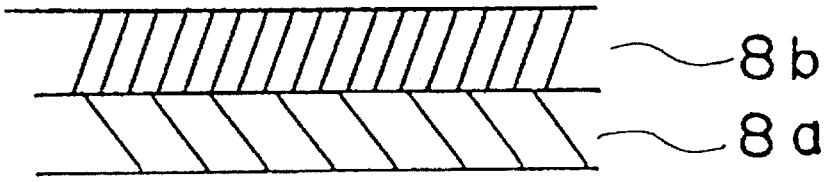
FIG. 5 and FIG. 6 show examples of section views of intermediate transfer members.

FIG. 5 is a section view of intermediate transfer member 1. In FIG. 5, reference number 8a refers to an aluminum substrate and reference number 8b refers to a cushion layer.

Production of Intermediate Transfer Member 2

Thirty parts AEROSIL R-972 (Aerosil Japan K. K.), used as a dry silica for reinforcement, was added to 100 parts TCM5417U (Toshiba Silicone Rubber K. K.), used as a conductive silicone rubber.

The aforesaid rubber was compression molded on the surface of an aluminum tube 80 mm in major diameter so as to obtain intermediate transfer member 2 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption rate of the obtained surface layer at this time was 0.09% as measured by methods defined in Japanese Industrial Standard (JIS) 6911.

Production of Intermediate Transfer Member 3

Twenty parts AEROSIL R-972 (Aerosil Japan K. K.), used as a dry silica, and 5 parts Syloid 150 (Fuji-Davison Chemical Co. Ltd.), a wet silica used as a water absorption agent, were added to 100 parts TCM5417U (Toshiba Silicone K. K.), used as a conductive silicone rubber.

The aforesaid rubber was compression molded on the surface of an aluminum tube 80 mm in major diameter so as to obtain intermediate transfer member 3 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption of the obtained surface layer at this time was 0.17% as measured by applying correspondingly the method defined in Japanese Industrial Standard (JIS) 6911.

Production of Intermediate Transfer Member 4

Thirty parts Syloid 150 (Fuji-Davison Chemical Co. Ltd.), a wet silica used as a water absorption agent, and 5 parts ethylene oxide-fatty acid condensate (trade name: Negomel; GM: Imperial Chemical Industry Co.) were added to 100 parts TCM5417U (Toshiba Silicone K. K.), used as a conductive silicone rubber.

The aforesaid rubber was compression molded on the surface of an aluminum tube 80 mm in major diameter so as to obtain intermediate transfer member 4 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption of the obtained surface layer at this time was 4.9% as measured by applying correspondingly the method defined in Japanese Industrial Standard (JIS) 6911.

Production of Intermediate Transfer Member 5

Thirty parts Syloid 150 (Fuji-Davison Chemical Co. Ltd.), a wet silica used as a water absorption agent, and 10 parts ethylene oxide-fatty acid condensate (trade name: Negomel; GM: Imperial Chemical Industry Co.) were added to 100 parts TCM5417U (Toshiba Silicone K. K.), used as a conductive silicone rubber.

The aforesaid rubber was compression molded on the surface of an aluminum tube 80 mm in major diameter so as to obtain intermediate transfer member 5 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption of the obtained surface layer at this time was 9.3% as measured by applying correspondingly the method defined in Japanese Industrial Standard (JIS) 6911.

Production of Intermediate Transfer Member 6

Thirty parts Syloid 150 (Fuji-Davison Chemical Co. Ltd.), a wet silica used as a water absorption agent, and 25 parts polyglygol ether (trade name: Antistatic Plasticizer KA; Bayer Chemical Co.) were added to 100 parts TCM5417U (Toshiba Silicone K. K.), used as a conductive silicone rubber.

The aforesaid rubber was compression molded on the surface of an aluminum tube 80 mm in major diameter so as to obtain intermediate transfer member 6 having an exterior diameter of 88 mm. Vulcanizing agents TC-23A and TC-23B (Toshiba Silicone K. K.) were added at rates of 0.5 parts and 1.2 parts, respectively, and primary vulcanization was accomplished at 170° C. for 10 min, and secondary vulcanization was accomplished at 200° C. for 1 min.

The water absorption of the obtained surface layer at this time was 13.2% as measured by applying correspondingly the method defined in Japanese Industrial Standard (JIS) 6911.

Production of Intermediate Transfer Member 7

Thirty parts Syloid 150 (Fuji-Davison Chemical Co. Ltd.), a wet silica used as a water absorption agent, and 20 parts carbon black, as a conductivity imparting agent, were added to 100 parts Hercular-H (Zeon Japan Co., Ltd.) used as an epichlorohydrin rubber compound.

The aforesaid rubber was compression molded on the surface of an aluminum tube 80 mm in major diameter so as to obtain intermediate transfer member 7 having an exterior diameter of 88 mm.

The water absorption of the obtained surface layer at this time was 1.5% as measured by applying correspondingly the method defined in Japanese Industrial Standard (JIS) 6911.

Production of Intermediate Transfer Member 8

Twenty parts carbon black S, as a conductivity imparting agent, was added to 100 parts Hercular-H (Zeon Japan Co., Ltd.) used as an epichlorohydrin rubber compound.

The aforesaid rubber was compression molded on the surface of an aluminum tube 80 mm in major diameter so as to obtain intermediate transfer member 8 having an exterior diameter of 88 mm.

The water absorption of the obtained surface layer at this time was 0.05% as measured by applying correspondingly the method defined in Japanese Industrial Standard (JIS) 6911.

Production of Intermediate Transfer Member 9

Twenty parts conductive carbon black was added to 100 parts acrylic resin Nipol AR32 (Zeon Japan), used as a cushion layer, and vulcanized for 30 min at 155° C.

Thirty parts Syloid 150 (Fuji-Davison Chemical Co.), a wet silica used as a water absorption agent, was added 100 parts silicone rubber FS XF-2560 (Dow-Corning), and this solution was applied over the aforesaid layer as a silicone protective overcoat layer having a thickness of about 5 μm to obtain intermediate transfer member 9.

To harden the aforesaid overcoat layer, 4 parts FSK-1638, a catalyst, were added to 100 parts FS XF-2560 and applied to the member, then hardened for 30 sec at 160° C. The water absorption of the obtained surface layer at this time was 1.6% as measured by applying correspondingly the method defined in Japanese Industrial Standard (JIS) 6911.

Figure 6:
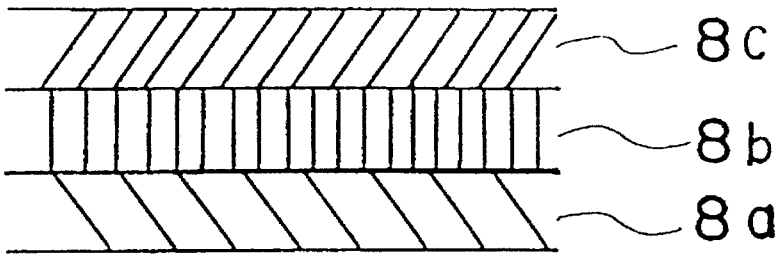

FIG. 6 is a section view of intermediate transfer member 9. In FIG. 6, reference number 8a refers to an aluminum substrate, reference number 8b refers to a cushion layer, and reference number 8c refers to a surface layer.

Production of Intermediate Transfer Layer 10

Twenty parts conductive carbon black were added to 100 parts acrylic resin Nipol AR32 (Zeon Japan), used as a cushion layer, and vulcanized for 30 min at 155° C. The aforesaid rubber was compression molded on the surface of an aluminum tube 80 mm in major diameter so as to obtain a member having an exterior diameter of 88 mm.

Thirty parts AEROSIL R-972 (Japan Aerosil), used as a dry silica for reinforcement, were added to 100 parts silicone rubber FS XF-2560 (Dow-Corning), and this solution was applied over the aforesaid layer as a silicone protective overcoat layer having a thickness of about 5 μm to obtain intermediate transfer member 10.

To harden the aforesaid overcoat layer, 4 parts FSK-1638, a catalyst, were added to 100 parts FS XF-2560 and applied to the member, then hardened for 30 sec at 160° C. The water absorption of the obtained surface layer at this time was 0.06% as measured by applying correspondingly the method defined in Japanese Industrial Standard (JIS) 6911.

EVALUATIONS

The aforesaid liquid developers and intermediate transfer members 1~10 were evaluated under the conditions described below using the image forming apparatus shown in FIG. 1.

Photosensitive drum surface potential: +1,000 V

Circumferential speed ratio of intermediate transfer member and photosensitive drum (rotational speed of developing roller/rotational speed of photosensitive drum): 10

Voltage applied to intermediate transfer member: −1,000 V

Temperature of transfer roller: 200° C.

Voltage applied to developing roller: −600 V

Spacing between developing roller and photosensitive drum: 200 μm

Spacing between squeeze roller and photosensitive drum: 200 μm

Image Drift on Surface of Photosensitive Drum

Using the previously described image forming apparatus, 300 dpi (dots per inch) one dot ON/OFF vertical lines were optically exposed by a optical unit to produce an image. The apparatus was stopped before primary transfer of the image, and the toner image on the surface of the photosensitive drum was dried via a drier, and thereafter microscopically examined. Image drift on the surface of the photosensitive drum was ranked by the levels below depending on whether or not separation of the aforesaid lines was visible. Rankings of ⊙ and ○ were acceptable. The results of evaluation are shown in Table 1.

⊙: All lines completely separate

○: Partial lines not separate; two lines in ten or fewer

Δ: Partial lines not separate; more than two lines up to nine lines in ten

X: No line separation

Transfer Efficiency

Solid images were printed using the aforesaid image forming apparatus. After the solid image was transferred from the intermediate transfer member to a transfer sheet (secondary transfer), the amount of toner adhering to said transfer sheet, and the amount of residual toner remaining adhered to the intermediate transfer member were measured. Transfer efficiency was determined based on the equation described below, and the results were ranked. In the rankings, Δ and better were acceptable. The results are shown in Table 1.

⊙: Transfer efficiency 95% or higher

○: Transfer efficiency 80% or higher, but less than 95%

Δ: Transfer efficiency 60 or higher, but less than 80%

X: Transfer efficiency less than 60%

| | Interm. Transfer Member | Water Absorption | Image Drift | 2nd Transfer Efficiency | Overall Evaluation |
|---|---|---|---|---|---|
| Ex. 1 | 1 | 1.8% | ⊙ | ⊙ | ⊙ |
| Ref Ex. 1 | 2 | 0.09% | ⊙ | X | X |
| Ex. 2 | 3 | 0.17% | ⊙ | ○ | ○ |
| Ex. 3 | 4 | 4.6% | ⊙ | ⊙ | ⊙ |
| Ex. 4 | 5 | 9.3% | ○ | ⊙ | ○ |
| Ref Ex. 2 | 6 | 13.2% | X | ⊙ | X |
| Ex. 5 | 7 | 1.5% | ⊙ | ⊙ | ⊙ |

-continued

| | Interm. Transfer Member | Water Absorption | Image Drift | 2nd Transfer Efficiency | Overall Evaluation |
|---|---|---|---|---|---|
| Ref Ex. 3 | 8 | 0.05% | ⊙ | X | X |
| Ex. 6 | 9 | 1.6% | ⊙ | ⊙ | ⊙ |
| Ref Ex. 4 | 10 | 0.06% | ⊙ | X | X |

As can be understood from the above examples and reference examples, sharp, highly detailed images can be obtained without reducing transfer efficiency by providing a material in the surface of the intermediate transfer member having a water absorption of 0.15~10 percent by weight, and ideally 1.5~5 percent by weight.

That is, when the water absorption is less than 0.15 percent by weight, secondary transfer efficiency is reduced due to less than adequate separation characteristics of the toner particles and intermediate transfer member, and toner offset phenomenon was confirmed when using a heat-pressure transfer method.

Conversely, when the water absorption is greater than 10%, the water content moves to the surface of the photosensitive drum, thereby reducing the resistance value of the photosensitive member surface, and causing the so-called image drift phenomenon.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image carrying member on which an electrostatic latent image is maintained;

a developing device that develops said electrostatic latent image to form a developer image by a liquid developer;

an intermediate transfer member having a surface layer onto which is transferred the developer image from the surface of the image carrying member, wherein said surface layer includes a polymer having low water absorbing power and an additive dispersed therein, said additive having high water absorbing power, a water absorption of said surface layer being in the range between 0.15 and 10.0 percent by weight;

a first transfer device that transfers the developer image from the image carrying member to the intermediate transfer member; and a second transfer device that transfers the developer image from the surface of the intermediate transfer member onto a recording member.

2. The image forming apparatus claimed in claim 1, wherein said polymer is at least one selected from the group consisting of silicone rubber or epichlrohydrin rubber.

3. The image forming apparatus as claimed in claim 1, wherein said polymer contains at least one conductive material selected from the group of conductive carbon, metal, polyacetylene, polypyrrole and polythiophene, said conductive material being dispersed therein.

4. The image forming apparatus as claimed in claim 1, wherein said additive includes silica produced in a liquid phase.

5. The image forming apparatus as claimed in claim 1 wherein the water absorption of the surface layer of said intermediate transfer member is in the range between 1.5 and 5.0 percent by weight.

6. The image forming apparatus as claimed in claim 1 wherein said liquid developer comprises a fluid medium and toner particles dispersed therein, said toner particles including polymer component.

7. The image forming apparatus as claimed in claim 6 wherein said fluid medium includes at least one material selected from the group of hydrocarbon resins, alicyclic hydrocarbons, aromatic hydrocarbons, halogenated hydrocarbons and polysiloxane.

8. The image forming apparatus as claimed in claim 6 wherein the concentration of toner particles in the fluid medium is in the range between 0.5 and 50 percent by weight.

9. An image forming apparatus, comprising:

an image carrying member on which an electrostatic latent image is maintained;

a developing device that develops said electrostatic latent image to form a developer image by a liquid developer:

an intermediate transfer member having a surface layer onto which is transferred the developer image from the surface of the image carrying member, a water absorption of said surface layer being in the range between 0.15 and 10.0 percent by weight, wherein said surface layer is formed of silicone rubber or epichlorohydrin rubber;

a first transfer device that transfers the developer image from the image carrying member to the intermediate transfer member; and a second transfer device that transfers the developer image from the surface of the intermediate transfer member onto a recording member, wherein said second transfer device comprises:

a pressing member which presses the intermediate member to the recording member in order to contact the developer image formed on the intermediate member to the recording member; and a heater heating a contact area where the pressing member presses against the recording member to the recording member.

10. A multi-color image forming apparatus, comprising:

an image carry member on which an electrostatic latent image is maintained;

a plurality of developing devices respectively accommodating liquid developers, the color of the developer being different from each other, said developing devices developing the electrostatic latent image by the liquid developer to form a plurality of developer images of different colors sequentially;

an intermediate transfer member having a surface layer onto which is transferred the color developer image formed on the surface layer of the image carrying member and which is maintained thereon, wherein said surface layer includes a polymer having low water absorbing power and an additive dispersed therein, said additive having high water absorbing power, a water absorption of the surface layer of said intermediate transfer member being in the range between 0.15 and 10.0 percent by weight;

a first transfer device that transfers color developer images formed on the surface layer of the image carrying member sequentially so that color developer images are overlaid; and a transfer device that transfers the overlaid developer images formed on the intermediate transfer member onto a recording member simultaneously.

11. The multi-color image forming apparatus as claimed in claim 10 wherein said developing devices accommodate developers selected from the group of yellow, magenta, cyan and black colored developer.

12. An image transferring method comprising steps of:

developing an electrostatic latent image maintained by an image carrying member by use of a liquid developer in order to form a developer image on the image carrying member;

first transferring the developer image formed on the image carrying member onto the surface layer of an intermediated transfer member, wherein said surface layer includes a polymer having low water absorbing power and an additive dispersed therein, said additive having high water absorbing power, a water absorption of the surface layer of said intermediate transfer member being in the range between 0.15 and 10.0 percent by weight; and second transferring the developer image from the intermediate transfer member onto a recording member.

13. An intermediate transfer member used in an image forming apparatus forming a liquid developer image, which temporarily supports the image thereon and has a water absorption in the range between 0.15 and 10.0 percent by weight, wherein said intermediate transfer member comprises:

a first layer including the surface on which the toner image is transferred, the water absorption of said first layer being in the range between 0.15 and 10.0 percent by weight; and a second layer formed of a support member, wherein said first layer includes a polymer having low water absorbing power and an additive a dispersed therein, said additive having high water absorbing power.

14. The intermediate transfer member as claimed in claim 13, wherein said polymer includes silicone rubber or epichlorohydrin rubber.

15. The intermediate transfer member as claimed in claim 13, wherein said polymer contains at least one conductive material selected from the group of conductive carbon, metal, polyacetylene, polypyrrole and polythiophene, said conductive material being dispersed therein.

16. The image forming apparatus as claimed in claim 13 wherein said additive includes silica produced in a liquid phase.

17. An intermediate transfer member used in an image forming apparatus forming a liquid developer image, which temporarily supports the image thereon and has a water absorption in the range between 0.15 and 10.0 percent by weight, wherein said intermediate transfer member comprises:

a first layer including the surface on which the toner image is transferred, the water absorption of said first layer being in the range between 0.15 and 10.0 percent by weight;

a second layer formed of a support member; and a third layer provided between said first layer and the second layer, said third layer formed of electrically conductive rubber material.

18. In an image forming apparatus which forms a liquid developer image and supports the image temporarily on the surface of an intermediate member, wherein said intermediate member has a water absorption in the range between 0.15 and 10.0 percent by weight and includes a polymer having low water absorbing power and an additive dispersed therein, said additive having high water absorbing power.

19. In an image forming apparatus which forms an electrostatic latent image on an image carrying member, applies a liquid developer to said electrostatic latent image to form a developer image on the image carrying member, transfers the developer image from the image carrying member onto an intermediate transfer member and transfers the developer image form the intermediate transfer member onto a recording member, said intermediate member having a water absorption in range between 0.15 and 10.0 percent by weight and including a polymer having low water absorbing power and an additive dispersed therein, said additive having high water absorbing power.

20. An intermediate transfer member for temporarily supporting a liquid developer image during a image forming cycle, said intermediate transfer member including a surface onto which the image is supported, said surface having a water abortion in the range between 0.15 and 10.0 percent by weight and including a polymer having low water absorbing power and an additive dispersed therein, said additive having high water absorbing power.

21. An image forming apparatus comprising:

an image carrying member on which an electrostatic latent image is maintained;

a developing device that develops said electrostatic latent image to form a developer image by a liquid developer;

an intermediate transfer member having a surface layer onto which is transferred the developer image from the surface of the image carrying member, a water absorption of said surface layer being in the range between 0.15 and 10.0 percent by weight, the surface layer of said intermediate transfer member is formed of silicone rubber or epichlorohydrin rubber;

a first transfer device that transfers the developer image from the image carrying member to the intermediate transfer member; and a second transfer device that transfers the developer image from the surface of the intermediate transfer member onto a recording member.

22. An intermediate transfer member used in an image forming apparatus forming a liquid developer image, which temporarily supports the image thereon and comprises:

a first layer including the surface on which the toner image is transferred, the water absorption of said first layer being in the range between 0.15 and 10.0 percent by weight;

a second layer formed of a support member; and a third layer provided between said first layer and the second layer, said third layer formed of electrically conductive rubber material.

* * * * *